US006962337B2

(12) United States Patent
Anderson

(10) Patent No.: US 6,962,337 B2
(45) Date of Patent: Nov. 8, 2005

(54) GAMING METHOD AND APPARATUS

(76) Inventor: Rose M. Anderson, 1434 Carrington La., Vienna, VA (US) 22182

( * ) Notice: Subject to any disclaimer, the term of this patent is extended or adjusted under 35 U.S.C. 154(b) by 0 days.

(21) Appl. No.: 10/695,765

(22) Filed: Oct. 30, 2003

(65) Prior Publication Data

US 2005/0093238 A1 May 5, 2005

(51) Int. Cl.[7] ..... A63F 3/00
(52) U.S. Cl. ..... 273/258; 273/236; 273/248
(58) Field of Search ..... 273/236, 242, 273/243, 248, 249, 250–256, 25, 258

(56) References Cited

U.S. PATENT DOCUMENTS 3,892,408 A * 7/1975 Small et al. ..... 273/278
4,938,482 A * 7/1990 Ludwick et al. ..... 273/260

OTHER PUBLICATIONS

Ex.Parte Breslow 192 USPQ 431.*

* cited by examiner

*Primary Examiner*—Vishu K. Mendiratta
(74) *Attorney, Agent, or Firm*—Smith, Gambrell & Russell, LLP

(57) ABSTRACT

A method and apparatus for gaming that arranges and uses numbers on its game board in a manner consistently with the first several rows of Pascal's Triangle. The gaming method and apparatus includes the use of tokens or chips that bear indicia corresponding to the same numbers of the game board, and the use of personages and their characteristics according to a point system. The chips may be acquired/discarded and traded for personages according to a point system. Furthermore, a subset of the chips may include a bonus indicator on the back which may be traded for bonus cards that are advantageous for play.

13 Claims, 17 Drawing Sheets

103
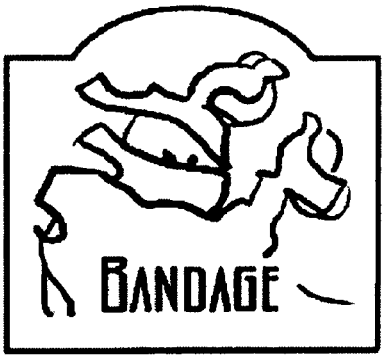
FIG 2A1
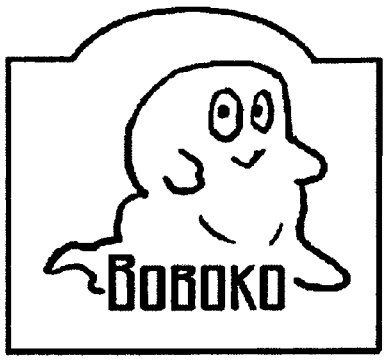
FIG 2A2
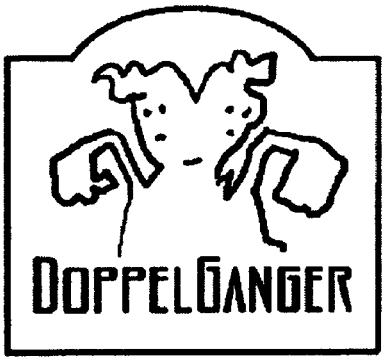
FIG 2A3
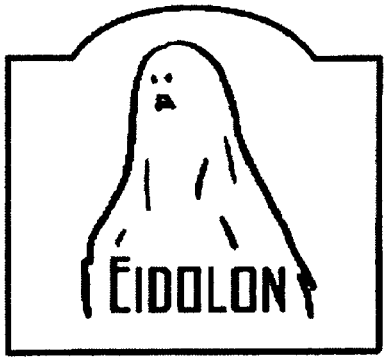
FIG 2A4

103
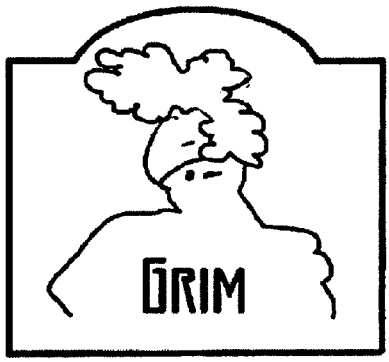
FIG 2B1
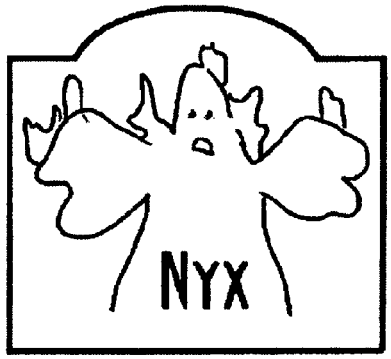
FIG 2B2
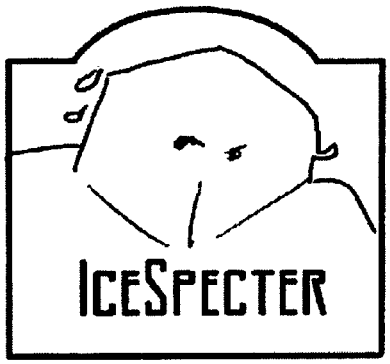
FIG 2B3
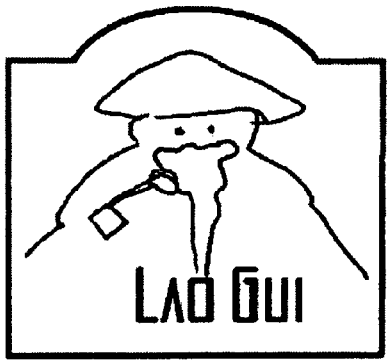
FIG 2B4
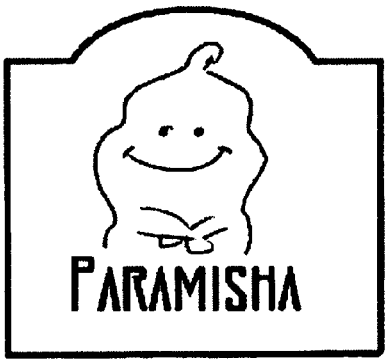
FIG 2B5
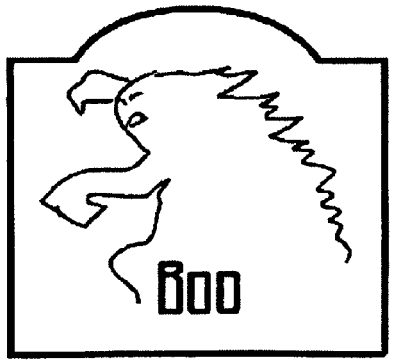
FIG 2B6

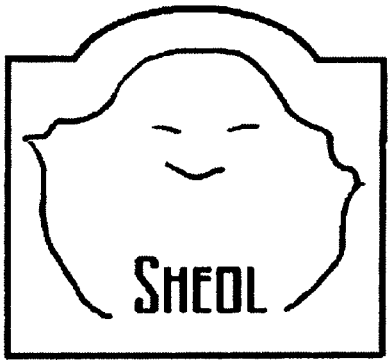
FIG 2C1
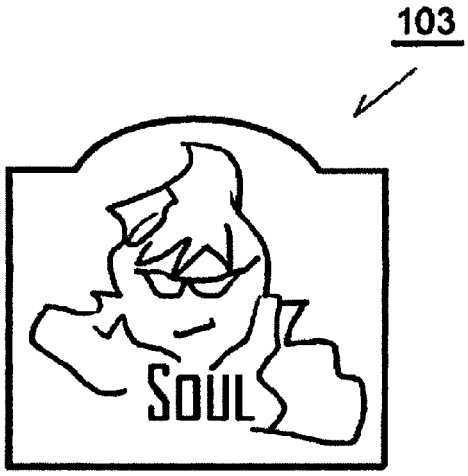
FIG 2C2
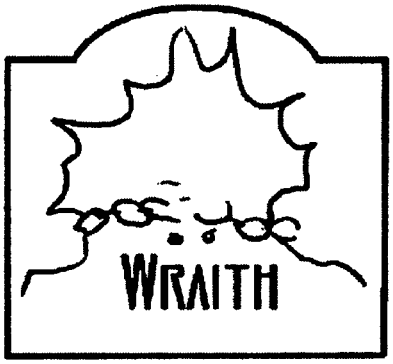
FIG 2C3

104
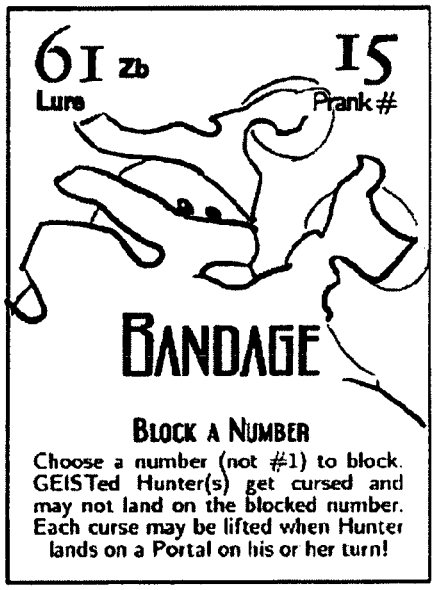
FIG 5A1
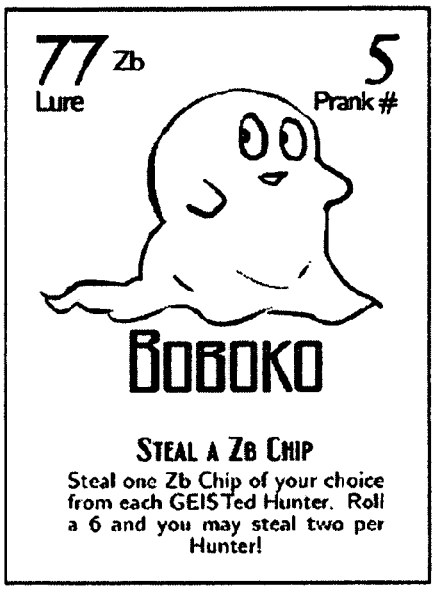
FIG 5A2
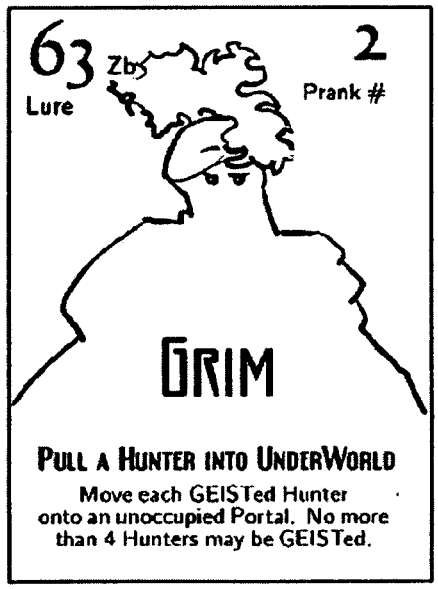
FIG 5A3
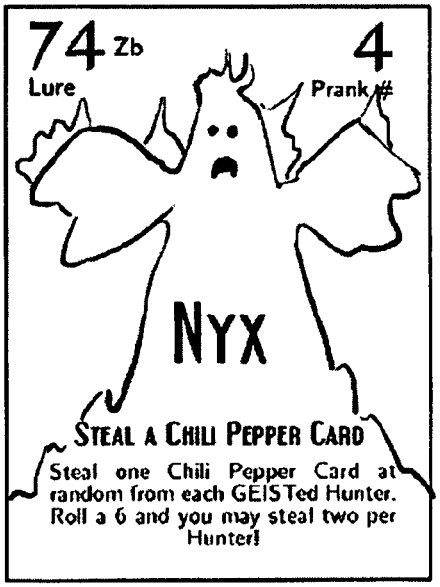
FIG 5A4

104
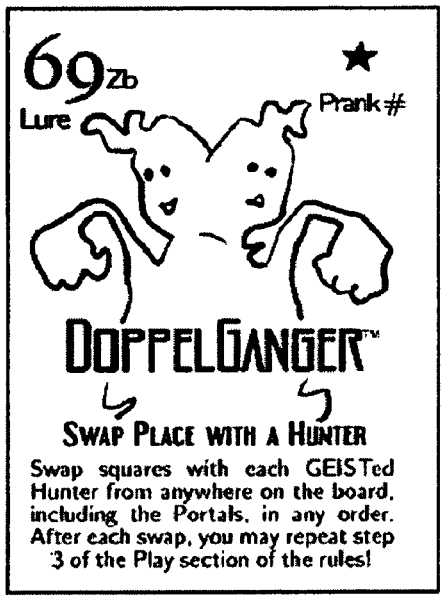
FIG 5B1
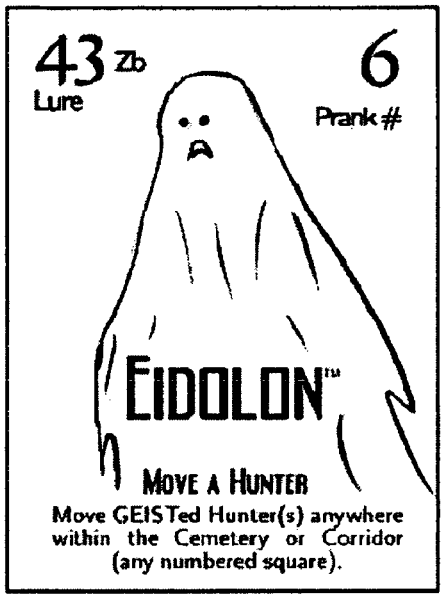
FIG 5B2
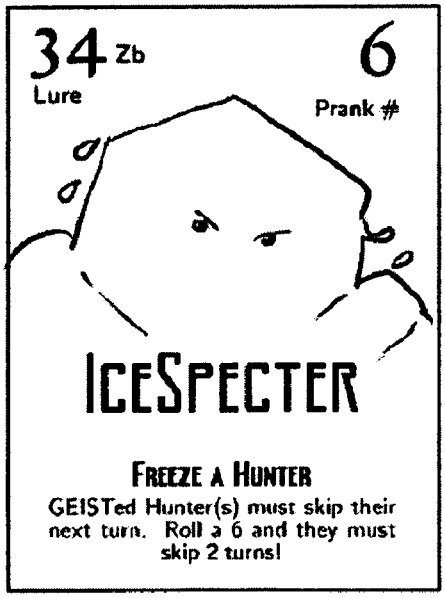
FIG 5B3
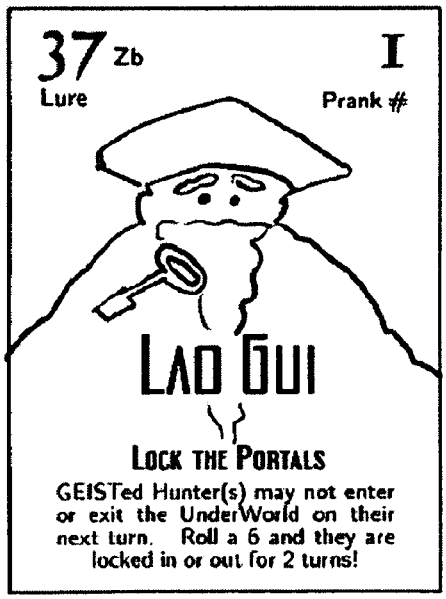
FIG 5B4

104
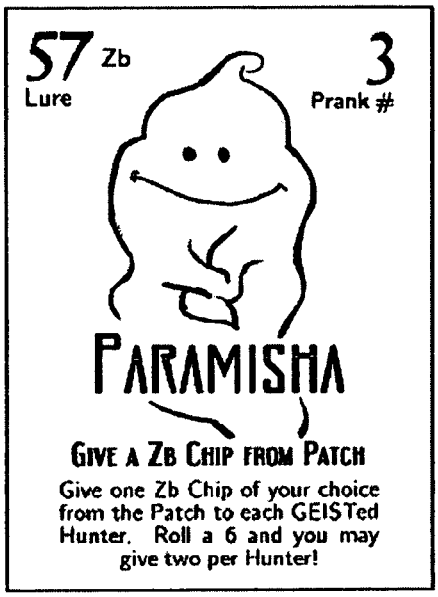
FIG 5C1
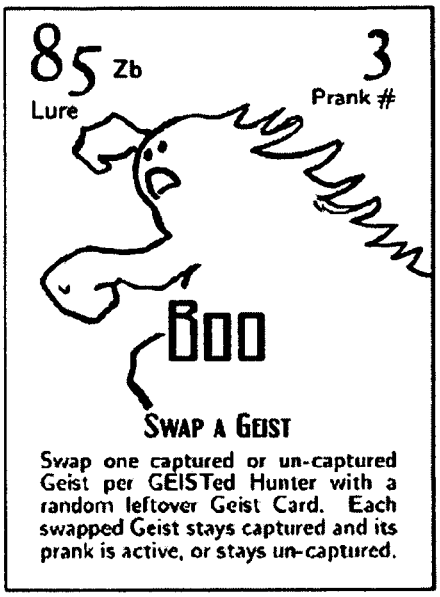
FIG 5C2
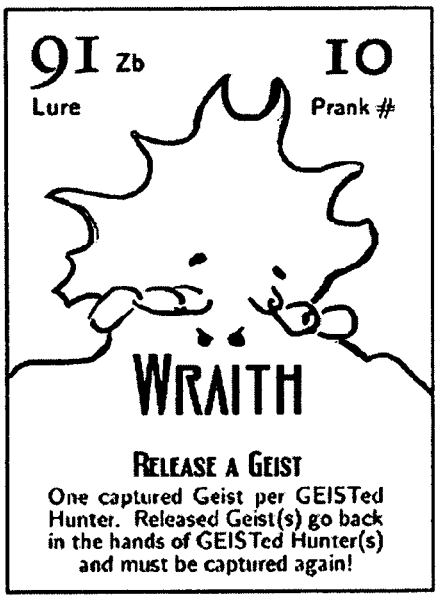
FIG 5C3
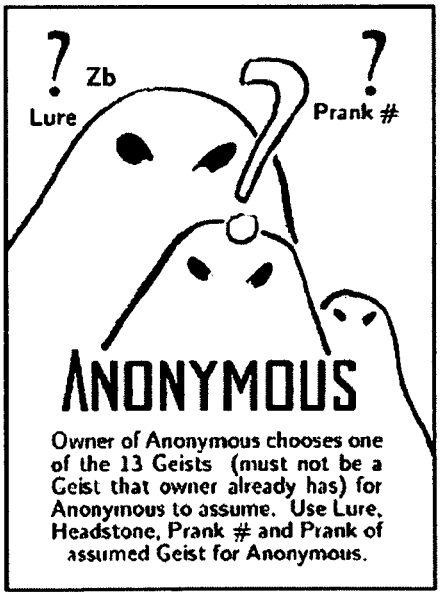
FIG 5C4

104
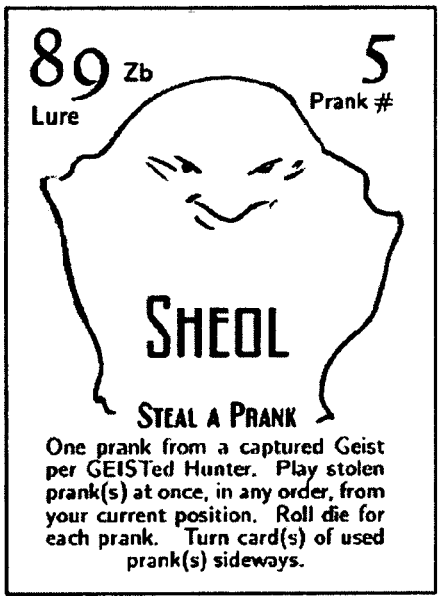
FIG 5D1
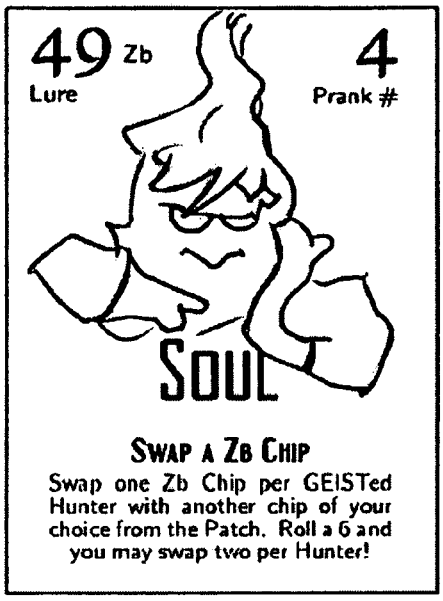
FIG 5D2
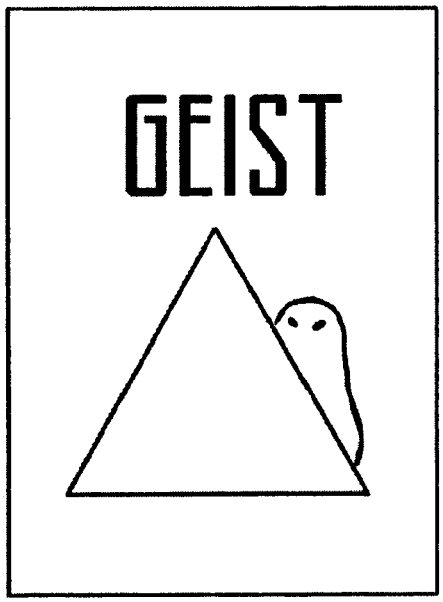
FIG 5D3

105
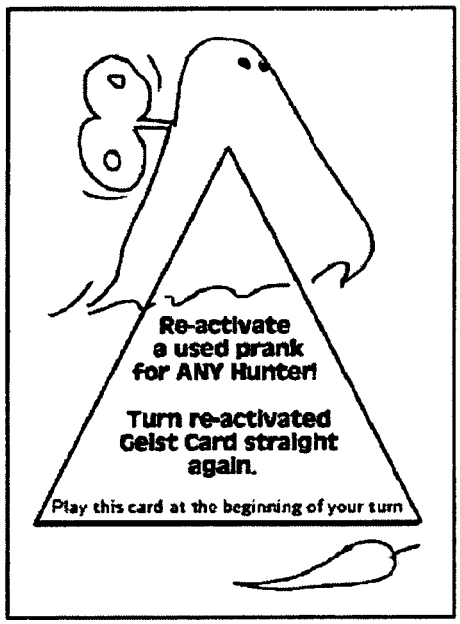
FIG 6A1
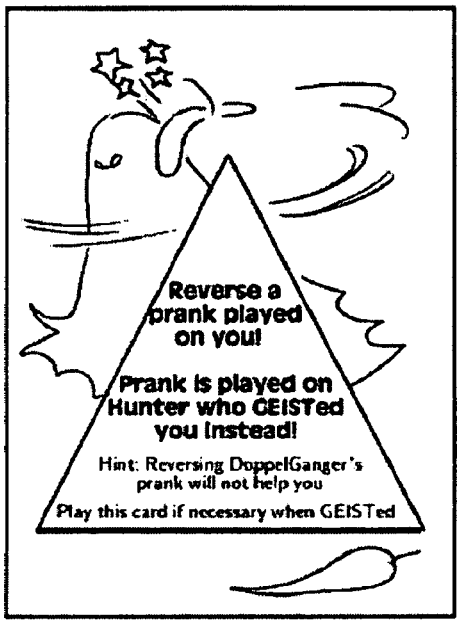
FIG 6A2
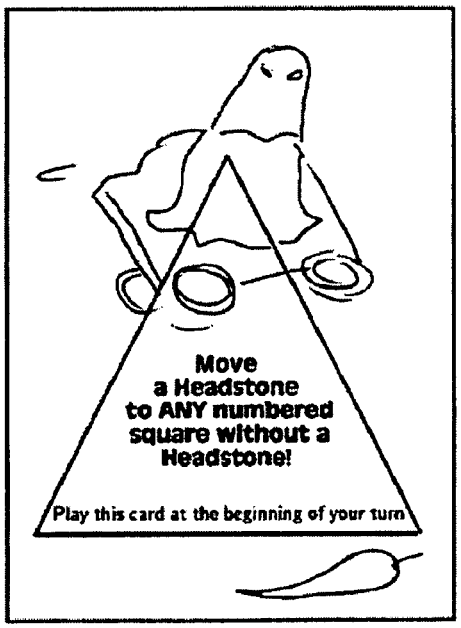
FIG 6A3
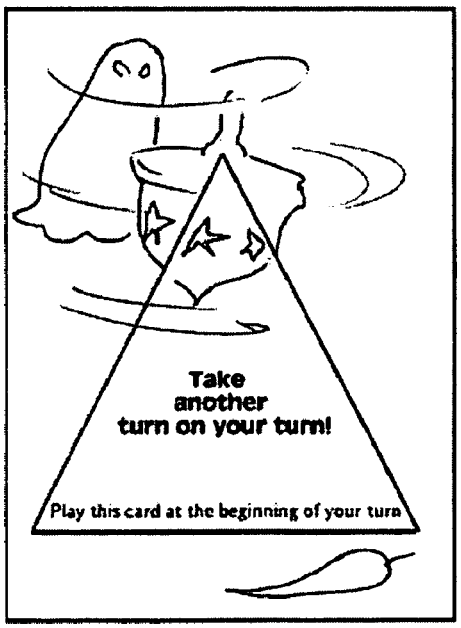
FIG 6A4

105
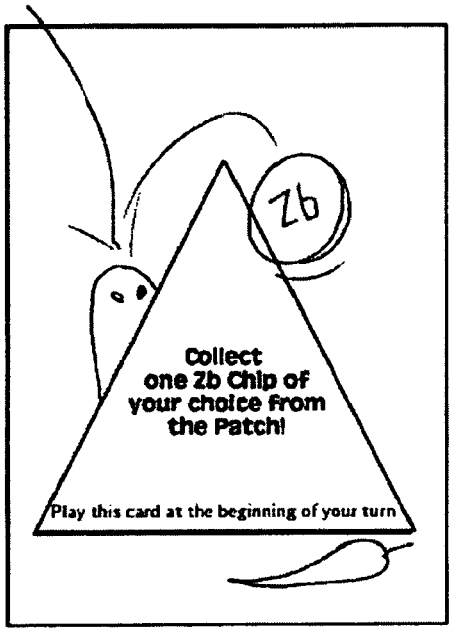
FIG 6B1
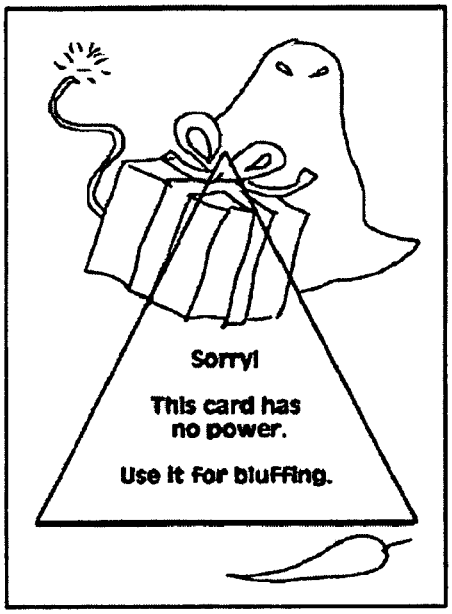
FIG 6B2
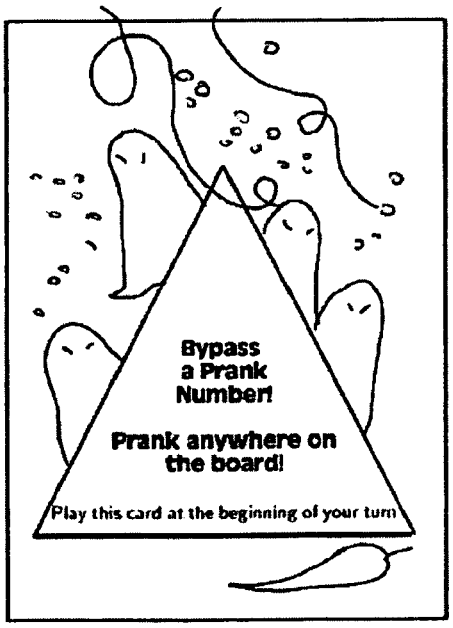
FIG 6B3
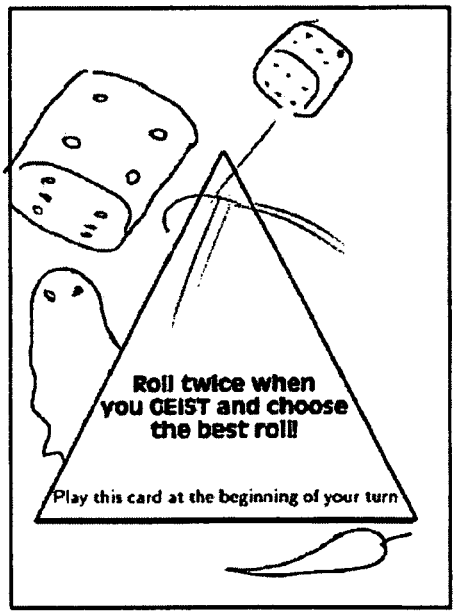
FIG 6B4

105
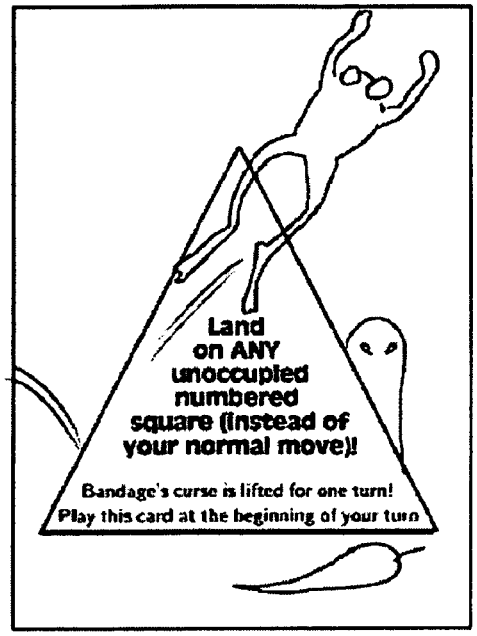
FIG 6C1
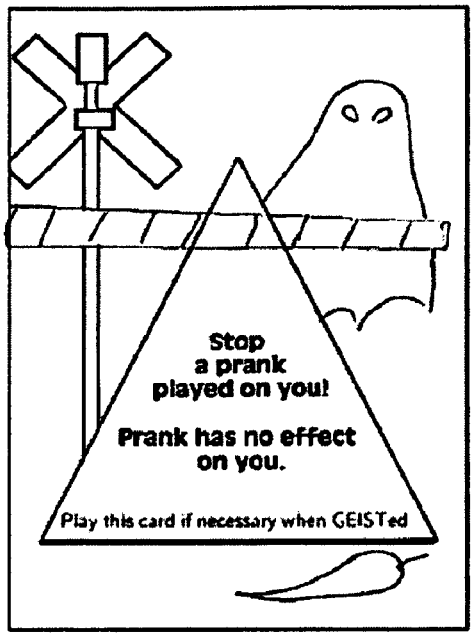
FIG 6C2
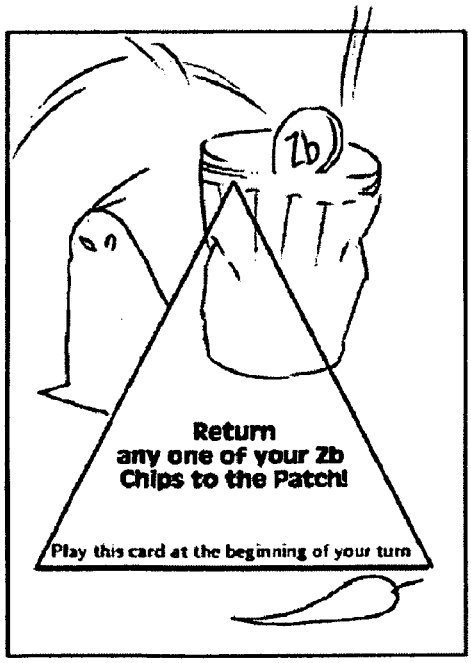
FIG 6C3
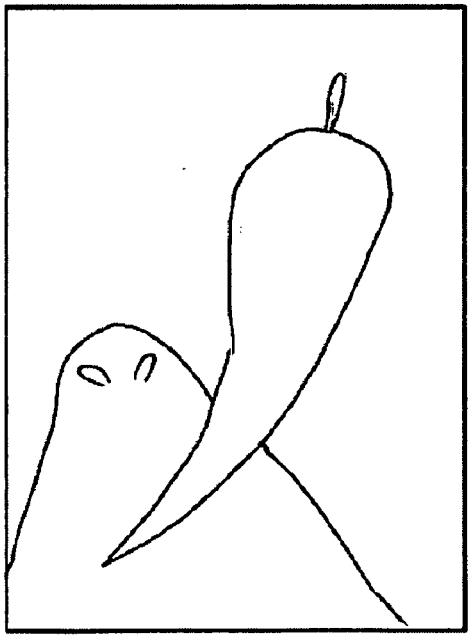
FIG 6C4

GAMING METHOD AND APPARATUS

This disclosure contains information subject to copyright protection. The copyright owner has no objection to the facsimile reproduction by anyone of the patent disclosure or the patent as it appears in the U.S. Patent and Trademark Office files or records, but otherwise reserves all copyright rights whatsoever.

BACKGROUND

1. Field of Invention

The present invention relates to games, and, more particularly, to games of skill.

2. General Background

Board games provide countless hours of thought-engaging, social entertainment for their players. However, the advent of inexpensive home computing has led to a rise in the popularity of video games. Many versions of board games may lack complexity, strategy and flexibility offered by modern video games, resulting in a preference by substantial numbers of game consumers for video games over board games. Excessive time spent playing video games may cause unwanted behavioral effects in the players.

Furthermore, players of video games often find it easier to identify with the icons or characters of the video game. This is particularly true for younger players, who may be drawn to the video game format. On the other hand, many older players are less likely to play video games. This disparity in game preferences can lead to less time spent together as a family for game playing.

Typical roll-the-die-and-move-your-piece board games are easy to learn and play, but may lack the depth to maintain interest for more than a few plays because they are based too much on random chance and thus do not offer complexity, strategy, or educational opportunities.

Recent trivia style games have become widely available; however, these games are repetitive and do not treat players equally because they focus solely on acquired knowledge. Thus, older players have a distinct advantage over younger players.

Typical strategy games provide greater depth but often feature war and combat themes which do not have the potential to appeal to the entire family and/or to all segments of society.

Thus, there exists a need for a family-oriented strategy board game which provides the social interaction families crave as well as possessing a universal theme and characters that are appealing to the entire family, boys, girls, young and old. This game should be dynamic, educational, as well as provide the intense and complex strategies of electronics which keep players involved in every moment of the game experience—a trait that can attract younger players accustomed to playing video games.

SUMMARY

Embodiments of the present invention include a gaming method and apparatus. A gaming apparatus may include a game board with spaces of two alternating colors, including spaces marked with a plurality of indicia that are arranged and assigned point values in a pattern consistent with the numbers within the first several rows of the Pascal's Triangle. The gaming apparatus may further include a plurality of game pieces and a plurality of decks of cards. One deck of cards contains a plurality of cards, each one of the cards being associated with a different personage. Each personage may be associated with or representative of a fixed number of points, and further, may be associated with a characteristic or ability allowing players to advance their play or slow down their opponents' play. A second deck of cards includes a plurality of bonus cards, each one of the cards may include a number of useful features advantageous for play. The gaming apparatus may further include markers bearing indicia representative of the personages. Players may distribute the markers randomly on the playing surface to indicate where on the board the personages may be acquired.

A gaming method may include moving a game pawn among spaces of a game board that are arranged and assigned point values consistent with the numbers within the first several rows of Pascal's Triangle, wherein the movement is conducted in accordance with rules of movement conceived by the inventor. The method may further include accumulating points equal to the point value of the spaces visited by the game pawn. The method may also include acquiring one of the player's randomly assigned plurality of personages when the player's points equals a number of points assigned to the personage. Acquiring a personage permits the exercise of the ability of the personage (such as, for example, the playing of an associated prank) upon players (opponents as well as the player him/herself) in accordance with an attribute assigned to the acquired personage. The method may also include acquiring all of the player's randomly assigned personages and moving the player's pawn to specific locations on the game board to discard them. The method may also include winning when the player has acquired and discarded all of their randomly assigned personages. In at least one embodiment, a personage may be a ghost or spirit.

BRIEF DESCRIPTION OF THE DRAWINGS

The invention claimed and/or described herein is further described in terms of exemplary embodiments. These exemplary embodiments are described in detail with reference to the drawings. These embodiments are non-limiting exemplary embodiments, in which like reference numerals represent similar structures throughout the several views of the drawings, and wherein:

FIGS. 2A1-2C3 are diagrams illustrating the headstone pieces according to at least one embodiment;

FIG. 3 is a diagram illustrating the hunter pawns in at least one embodiment;

FIGS. 5A1-5D3 are illustrations of several personages and their properties according to an embodiment;

FIGS. 6A1-6C4 are diagrams showing the bonus cards and their properties according to an embodiment;

DETAILED DESCRIPTION

Figure 1:
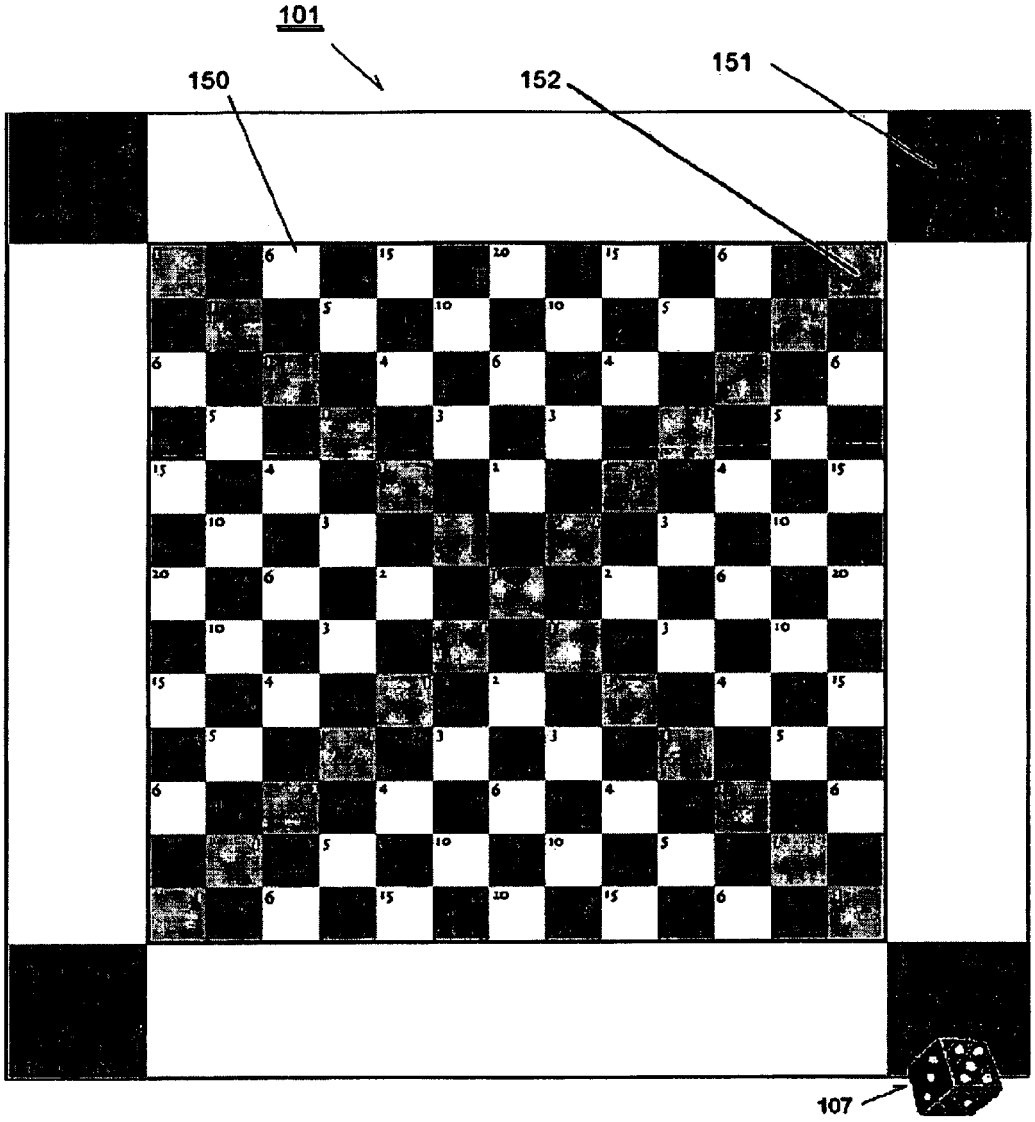
FIG. 1 is an illustration of a game board according to at least one embodiment.

Embodiments of the present invention may include a method and an apparatus for gaming. In particular, a game may include a method and an apparatus for playing a game according to a set of game rules using equipment configured for play according to the rules. At least one embodiment of the method and apparatus are described herein according to an example ghost hunting game.

In these embodiments, the game may be developed around a premise in which a fictional or non-fictional town (e.g., "Styxville") has been tormented for years by a number of mischievous personages (e.g., ghosts). In an embodiment, there may be thirteen different ghosts, each of which may have escaped from the underworld and taken over the town cemetery. The players of the game may take on the role of a ghost hunter that has come to rescue Styxville. In playing the game, each hunter attempts to win by being the first hunter to capture and deliver all of his assigned ghosts back to the underworld.

In at least one embodiment, the gaming apparatus 100 may include a game board 101, hunter pawns 102, headstones 103, personage cards 104, bonus cards 105, tokens or chips 106, and a die 107. In at least one embodiment, up to five players may play a single game. Therefore, in such embodiments, five hunter pawns 102 may be provided. Furthermore, in an embodiment, thirteen headstones 103 may be provided, corresponding to each of the thirteen different personages (e.g., ghosts). In at least one embodiment, twenty-seven personage cards 104 may be provided (for example, two duplicate sets of cards for the thirteen ghosts, plus one anonymous card). In at least one embodiment, thirty-seven bonus cards 105 may be provided. Furthermore, the bonus cards 105 may be provided as thirty-seven chili pepper cards (for example, eleven sets of cards of varying number totaling 37). In addition, the chips 106 may include 117 Zingiberis ("Zb") chips.

FIG. 1 is a game board according to at least one embodiment. Referring to FIG. 1, a game board 101 may be composed of the cemetery (e.g., the set of white numbered spaces 150), the corridor (e.g., the set of red '1' spaces 152) and the portals 151 to the underworld (e.g., the four exterior black spaces). The numbers on the board may correspond to the number of spaces a player may move on his turn.

In at least one embodiment, game board 101 may be made from a rigid material, such as cardboard, and contain two main portions: (1) a checkerboard style playing surface plus four exterior spaces, and (2) the border around the playing surface containing the personages and their properties that may be used as reference by the players. Furthermore, indicia on the checkerboard style playing surface may be arranged in a manner consistent with the numbers within the first several rows of Pascal's Triangle, resulting in four overlapping implementations of the first several rows of Pascal's Triangle as shown in FIG. 1. This arrangement as part of a gaming apparatus, when provided along with a set of rules of movement, has been found to provide a number of advantages for gaming and supports a challenging gaming method as described herein.

In at least one embodiment, the game board may include bounded spaces arranged in a pattern consistent with the Pascal Triangle to include four sets of rows 0 to 6 of the Pascal Triangle arranged such that each set shares the topmost row (i.e., row 0 is common). In at least one embodiment, the game board spaces may be squares. Other shapes are possible. FIG. 1 illustrates this exemplary embodiment. Other arrangements consistent with the Pascal Triangle are possible.

Unlike many other board games which use the board just to keep track of players' progress in the game, embodiments of the present invention require players to use the relationships between the numbered spaces 150 on the board 101 to generate their movements. Furthermore, the board 101 itself is a tool in a player's arsenal.

The basis for the game board 101, Pascal's Triangle, embodies many known and as yet unknown particular mathematical relationships. These relationships have fascinated mathematicians since ancient times. Pascal's Triangle is not only known for its extraordinary internal patterns and relationships, but also for its applications in several fields of mathematics. A few of the properties of Pascal's Triangle are described in the Appendix attached hereto, and may also be found on the World Wide Web at "playgeist.com." The inventor has discovered the utility of Pascal's Triangle for gaming.

Figure 4A:
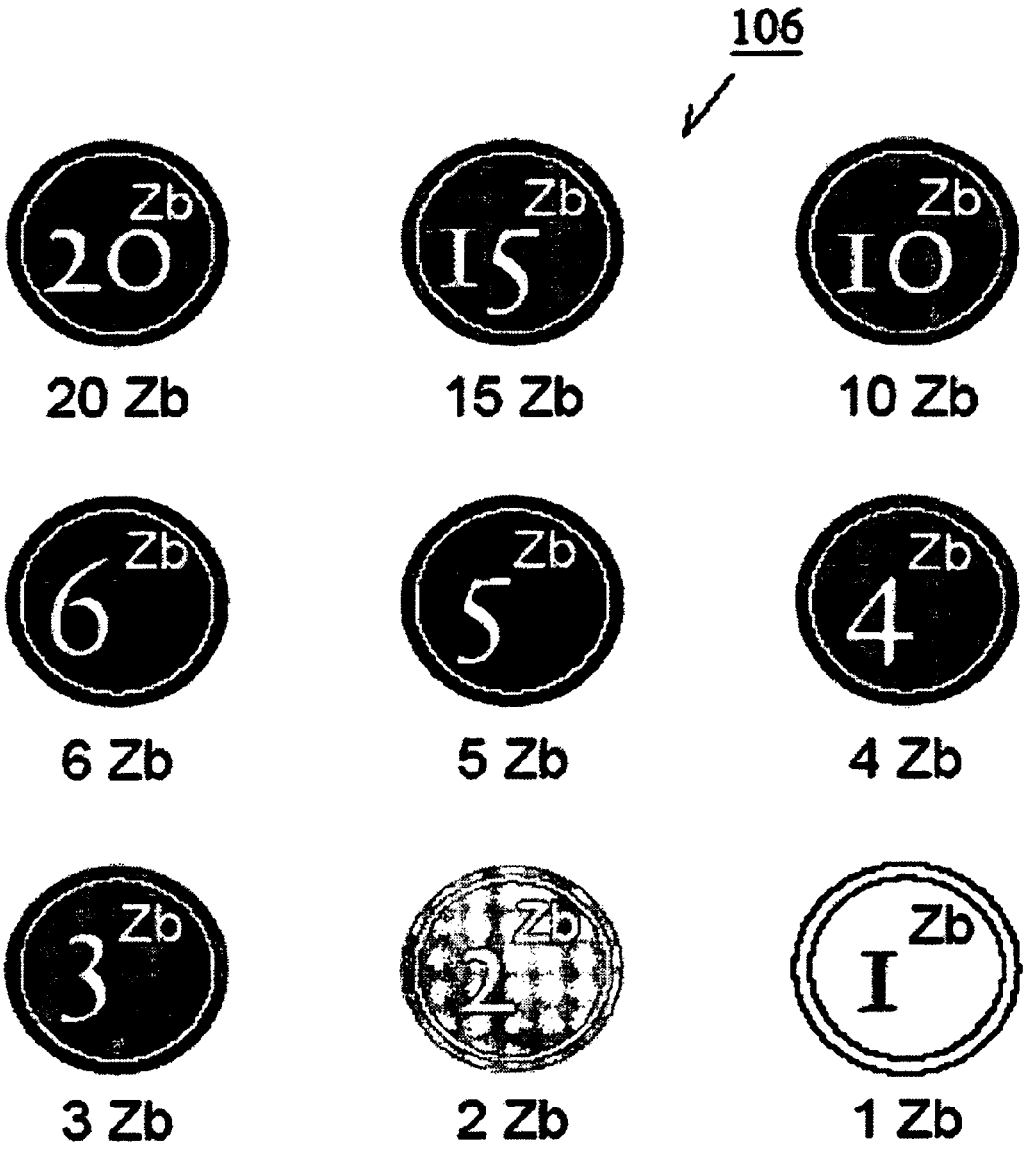
FIG. 4*a* is a diagram illustrating the front of the Zingiberis chips according to at least one embodiment.

In at least one embodiment, each of the chips 106 may be labeled to represent a portion of luring material for a personage. In at least one embodiment, the lure is Zingiberis (or, "Zb"), the aroma of which is said to attract ghosts. In play, a player collects Zingiberis to lure the ghosts desired to be captured. Zingiberis may come in "Patches" of 1, 2, 3, 4, 5, 6, 10, 15 and 20 that correspond to the numbers on the board 101. FIG. 4*a* illustrates the front of the chips 106 in at least one embodiment. To capture a ghost, a player collects Zingiberis (Zb) around the board as lures and exchanges them for the ghost when the player has accumulated an amount of Zb that equals the number assigned to the corresponding ghost.

In at least one embodiment, to collect lure (e.g., Zb), a player may land his hunter pawn 102 on any numbered space 150 (even those with Headstones) according to the rules described herein. Upon landing on a numbered game board space 150, a player may take one Zb chip 106 (if available) or may discard one Zb chip 106 that matches the number of the space 150. In a preferred embodiment, chips 106 are always taken from the front of the patches, and returned to the back. Chips 106 must be displayed at all times and may not be altered in any way. For example, exchanging a "10 Zb" chip for two "5 Zb" chips is not allowed.

In at least one embodiment, the thirteen characters or ghosts may be represented by the headstones 103 that are randomly distributed on the board 101 at beginning of play. FIGS. 2A1-2C3 are diagrams illustrating exemplary headstone pieces. Before the hunt (i.e., game) begins, each hunter (e.g., player) is dealt five personage cards 104 (e.g., ghost cards). Each ghost card may include an indication of, in an embodiment, the number of lure (e .g., Zb) required to capture the ghost, and a description of the personage's characteristics (e.g., the prank this ghost can play on the players and the prank number which indicates where on the board the prank may be played). Examples of ghost cards 104 are shown in FIGS. 5A1-5D3.

In play, a method may include keeping each ghost card 104 hidden from the view of the other hunters (i.e., players) before the ghost has been captured. After the ghost has been captured, the ghost card 104 may be laid straight and face up before its prank is used. After the prank is used, the ghost card may be laid sideways and face up. Each ghost prank may be used only once after the ghost has been captured.

To capture a personage or ghost, a player first must land on the headstone 103 corresponding to that ghost on the game board 101 after the player/hunter has collected the exact lure, no more and no less. In play, it may be customary for a capturing player to show the required Zb chips 106 to the other hunters before returning them to the patches. Then, the player may lay the ghost card 106 down, straight and face-up in front of him. As noted herein, a player cannot capture a ghost if the player is holding too many Zb.

Figure 3:
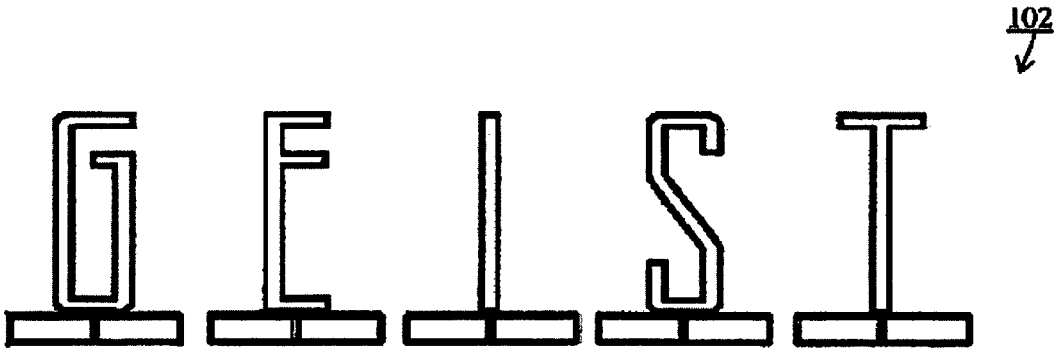

FIGS. 5A1-5D3 show a number of exemplary ghosts in an embodiment. Referring to FIG. 5B3, IceSpecter's lure is 34, for example. If a player has collected 20 Zb, 15 Zb, 10 Zb, and 4 Zb, then the player must get rid of the 15 Zb first. Also, no change (i.e., remainder lure after exchange) is allowed. For example, if a player has collected 20 Zb and 15 Zb, the player cannot capture IceSpecter either.

In at least one embodiment, a personage or ghost may represent a real-life historical character.

After a player captures (or recaptures) a ghost, on any future turns the player may use the ghost's prank to Geist™ or play its prank on any hunters, including the player holding that ghost. In an embodiment, up to five hunters (players) may be Geisted™ at the same time. For example, in order to Geist™ or play a prank on a hunter (player), the following method may be used:

1. Land on any numbered space 150 (even those with headstones 103) that corresponds to the ghost's characteristic—(i.e. prank number).

2. Turn the ghost card 106 sideways.

3. State aloud who (i.e., which players) you want to Geist™, then roll the die 107.

As an example, in order to Geist™ one hunter, the pranking player must roll a number greater than '1' using the a random number generator such as the die 107. To Geist™ two hunters, a player must roll a number greater than '2.' To Geist™ three hunters, the pranking player must roll a number greater than '3,' etc. If the pranking player rolls successfully, the prank is played at once on each Geisted™ hunter, in the order of the pranking player's choice; otherwise the prank is used up and the turn ends.

In at least one embodiment, in a two-player game, a Geisted™ hunter other than the pranking player counts as two hunters. Thus the pranking player must roll a number greater than '2' to Geist™ his opponent successfully.

Figure 4B:
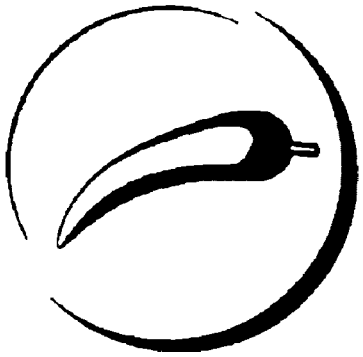
FIG. 4*b* is a diagram illustrating the back of the Zingiberis chips according to at least one embodiment.

In at least one embodiment, the game may include a set of bonus cards 105. Each one of the cards may bear indicia instructing players how to implement special protection or activities/movement variations designed to advance their play. FIGS. 6A1-6C4 illustrates a set of bonus cards 105 and properties in accordance with at least one embodiment. In an embodiment, the bonus cards 105 may be acquired by obtaining a token or chip 106 with a bonus card indicator on its back. In at least one embodiment, a subset of the chips 106 may include a bonus card indicator and the bonus card indicator may be a "chili pepper." FIG. 4*b* illustrates the back of a chip 106 having a bonus card indicator 130 (e.g., a chili pepper). Thus, in an embodiment, a subset of the chips 106 may include a chili pepper on the back. A player holding a chip 106 with a chili pepper on the back may exchange the chip 106 for a bonus card 105 (e.g., a chili pepper card). In an embodiment, in order to exchange a chip 106 for a bonus card 105 (or chili pepper card), at the beginning of a turn, the player may show the chili pepper on the chip, return the chip to its patch, then draw a chili pepper card from the top of the deck. It may be customary to place the card face down in front of the player's position. It should be borne in mind that more than one chip with the bonus card indicator can be exchanged in one turn.

In order to play a chili pepper card, a player may do so at the beginning of his turn or as necessary when Geisted™. Show the card before returning it to the bottom of the deck. It should be borne in mind that more than one chili pepper card can be played in one turn.

In play, in an embodiment, movement of the hunter pieces or pawns 102 may be performed in accordance with a set of rules. In at least one embodiment, play is governed by adherence to the following rules.

Figure 9:
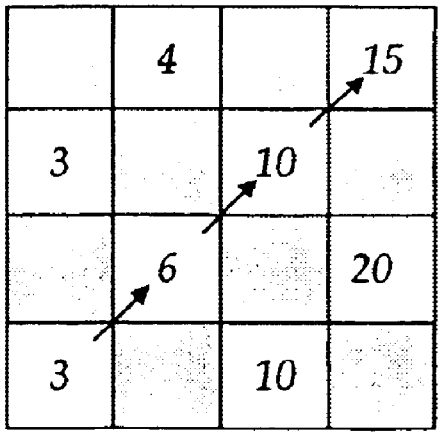
FIG. 9 is a diagram showing diagonal movement.
Figure 10:
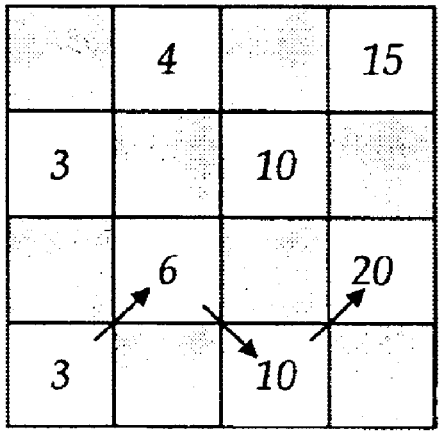
FIG. 10 is a diagram illustrating zigzagging movement.
Figure 11:
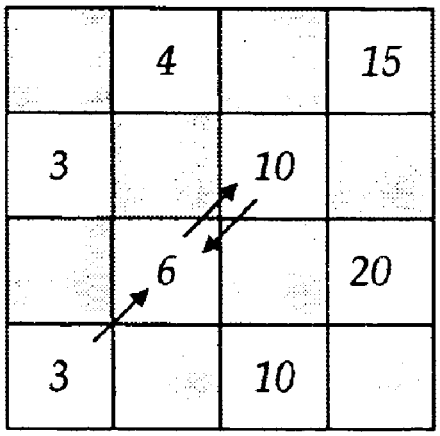
FIG. 11 is a diagram showing backtracking movement.

First, a player may only move diagonally the number of steps equal to the number of the space 150 upon which the player begins her turn. This includes: straight diagonal movement in any direction (FIG. 9), zigzagging (FIG. 10) and back-tracking (FIG. 11).

Second, a player may pass through, but may not land on the same numbered space 150 occupied by the player at the start of his turn, except in the corridor, where a player may move from '1' to '1'. For example, a player may not move from a '2' to a '2', nor from a '4' to a '4', etc.

Third, a player may pass through, but may not land on an occupied space. In an embodiment, an occupied space may be a space on the board 101 upon which the game piece 102 of another hunter or player is situated.

In an embodiment, additional rules may be added to promote more challenging play. For example, headstones 103 may be distributed on the board such that there is only one headstone 103 per row. As another example, a player may pass through, but not be allowed to land on any space with a headstone 103 except to capture a ghost.

In at least one embodiment, any deviation from the rules of movement can be contested. After a player moves, the other players or Hunters can contest the movement by calling out a "Challenge." If a challenged player cannot prove his move, that player must go back to where he last moved from and his turn ends. Otherwise, the contesting player must forfeit her next turn. Challenges may be called until the next hunter finishes his/her move.

In an embodiment, a player does not need to count out all his steps. Through backtracking (see FIG. 11), movement may be shortened. In fact, if a player is sitting on an even number, the player may move an even increment (or number of spaces) away, up to that number. Likewise, if a player is sitting on an odd number, the player may move an odd increment away, up to that number. For example, from a '20', an even number, one may move the equivalent of two steps to a '6,' or the equivalent of four steps to a '2,' etc. . . . up to twenty steps. Similarly, from a '15', an odd number, one may move the equivalent of one step to a '10,' or the equivalent of three steps to a '3,' etc. . . . up to fifteen steps.

In at least one embodiment, the game may include an area from which the personages emerge. In an embodiment, the area may be characterized as an underworld (not shown) from which the ghosts have escaped. To enter the underworld, a player must land on a "portal" space 151 by exact count according to the rules of movement. To exit the underworld from a portal space 151, a player may move onto any '1' corner space. To deliver captured ghosts to the underworld, a player must land on a portal space 151. Once on a portal space 151, a player may return any number of his captured ghost cards to the deck of leftover ghost cards 104. In an embodiment, ghosts that are delivered to the underworld become both harmless (i.e., their prank can no longer be used) and invulnerable to other pranks.

In an embodiment, play may include the following actions. A player may select a ghost hunter pawn (i.e., hunter pawn 102) and roll the die 107. The hunter pawn 102 may then be placed on the game board 101 on a numbered space 150 that was rolled using the die 107. In the rare case that all five hunters rolled a '2', the players will roll again since there are only four '2' spaces on the board. The player (e.g., hunter) on the highest numbered space 150 moves first (youngest aged hunter wins a tie). Play proceeds clockwise. In an embodiment, the die 107 is only used for Geisting™ during play and not for movement.

At each turn, a player performs the following:

STEP 1 (optional)—Before moving, a player may exchange chili pepper(s) for chili pepper card(s) and/or play a chili pepper card(s). After a player moves, STEP 1 is no longer an option.

STEP 2 (optional)—The player must move to another space (if possible) according to the rules of movement.

STEP 3 (mandatory)—The player must pass or do one (and only one) of the following:

a. Collect or discard Zingiberis.

b. Capture a ghost.

c. Geist™ hunter(s) (e.g., play a prank).

d. Deliver captured ghost(s) to the underworld.

A turn may end after STEP 3. To win, a player must be the first player/hunter to capture and deliver all his ghosts to the underworld with no Zingiberis left in his possession.

Figure 7:
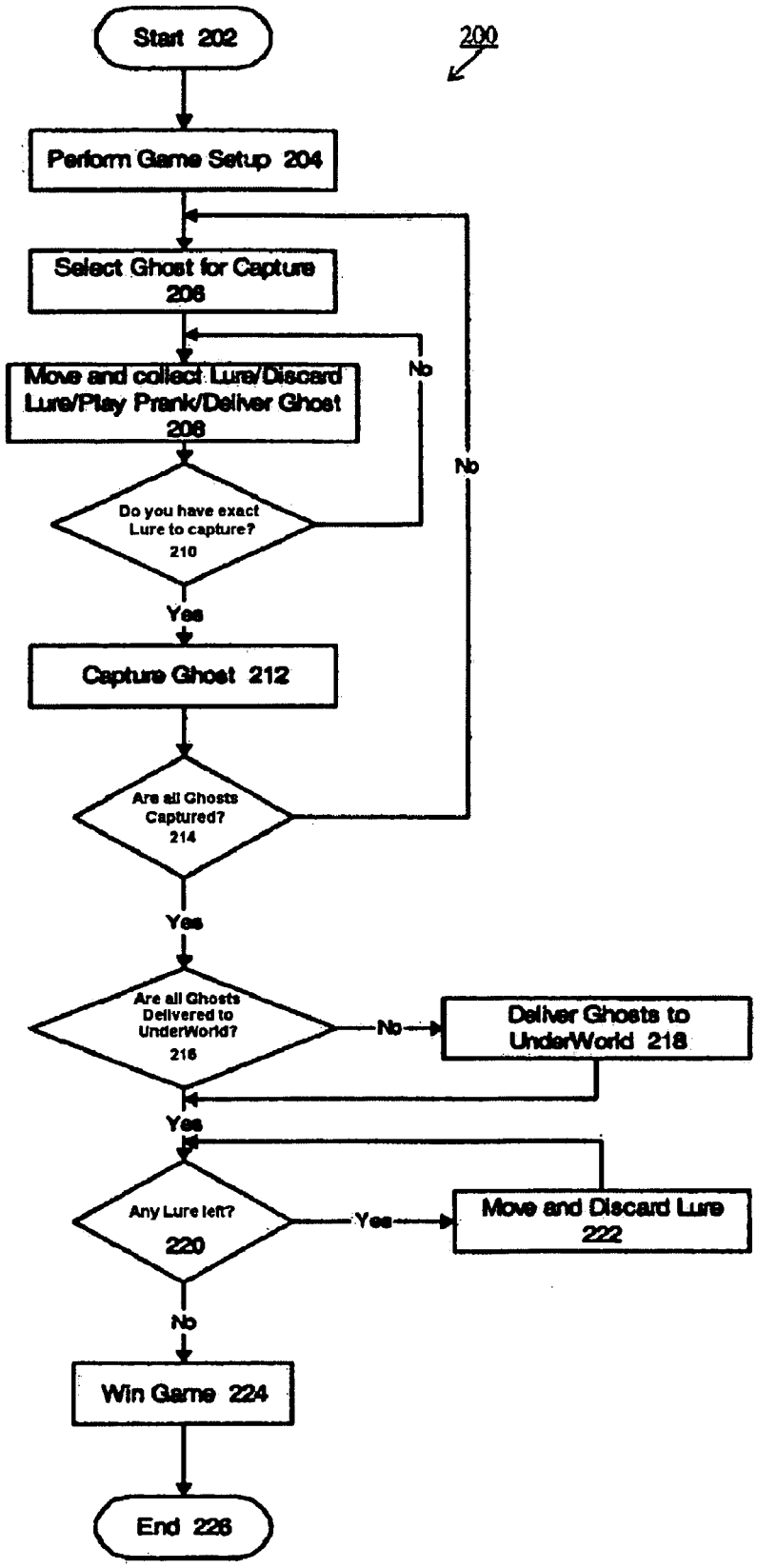
FIG. 7 is a flow chart illustrating a method according to at least one embodiment.

FIG. 7 is a flow chart of a method 200 according to at least one embodiment. To win the game, a player must be the $1^{st}$ to capture and deliver all his ghosts to the underworld. The nuances and strategies of choosing the order in which to capture ghosts, who and when to "Geist™" (e.g., play a prank), or when to deliver ghosts to the underworld, etc. will reveal themselves the more one plays. Referring to FIG. 7, the method 200 may commence at 202. Play may then proceed to 204 at which the players (e.g., hunters) may perform game set up. Further details regarding game set up are described with respect to FIG. 8.

Following game set up, play may proceed to 206, at which each player (e.g., hunter) may select a ghost to collect. In an embodiment, each ghost contained on a ghost card has a unique lure amount and prank. Capturing a ghost requires that a player try to collect lure (e.g., in an embodiment, Zb chips) as the player traverses the game board, and then exchange the collected lure for the ghost in as few turns as possible. In play, a player should collect Zb chips in an efficient manner that takes into account the number required to acquire the ghost of her choice; otherwise, the player may waste turns discarding the excess lure. In at least one embodiment, the higher the lure indicated on the ghost card, the more powerful the ghost prank, but the longer it will take to capture the ghost. A player holding relatively high lure/prank value ghost cards may rely on the powerful pranks to overcome other players with lower value hands.

Play may then proceed to 208, at which players may take turns traversing the game board according to the game rules, and thereby collecting lure. On each turn, a player must move the number of steps indicated by the number shown on the space upon which the player began. Upon landing on a space, the player must either take or discard one Zb chip (e.g., lure) matching the number of the space landing upon or pass. Turn then passes to the next player. A player repeats this step until he has the exact amount of lure (no more and no less) required to capture the desired ghost for capture.

After a player has acquired sufficient lure, control may proceed to 210 at which a player may capture the corresponding ghost. To capture a ghost, a player traverses the game board to land on the space containing the corresponding headstone space for the ghost. It is advantageous to try to land on the ghost's headstone in as few turns as possible. Once on the headstone, a player may return lure chips after showing them to the other players/hunters. In play, it is customary to lay the ghost card for the captured ghost down, face up in front of the capturing player. Steps 206 through 212 may be repeated until each of the remaining ghosts held by a player (as indicated by that player's personage cards) are captured, at 214. After a ghost is captured, the capturing or holding player may play its prank on any player, including the player holding the ghost. This manner of play may be employed to slow down the other players, and advance one's position in the game. Furthermore, after a ghost is captured, the player may, on his turn, land on any unoccupied portal (e.g. one of the four exterior black spaces on the game board) to deliver the ghost to the underworld.

Play may then proceed to 216. In at least one embodiment, the first player to deliver all her captured ghosts to the underworld with no remaining chips, at 216, and who has no lure (e.g., Zb chips) remaining, at 220, wins the game, at 224. The remaining players may then continue play to determine ordered finishing positions (e.g., $2^{nd}$, $3^{rd}$ or $4^{th}$ place finishes). If the player has not delivered all ghosts to the underworld, play may proceed to 218 at which the player may deliver ghosts to the underworld. If the player has any lure remaining, play may proceed to 22, at which the player may move and discard lure. A method may end at 226.

Figure 8:
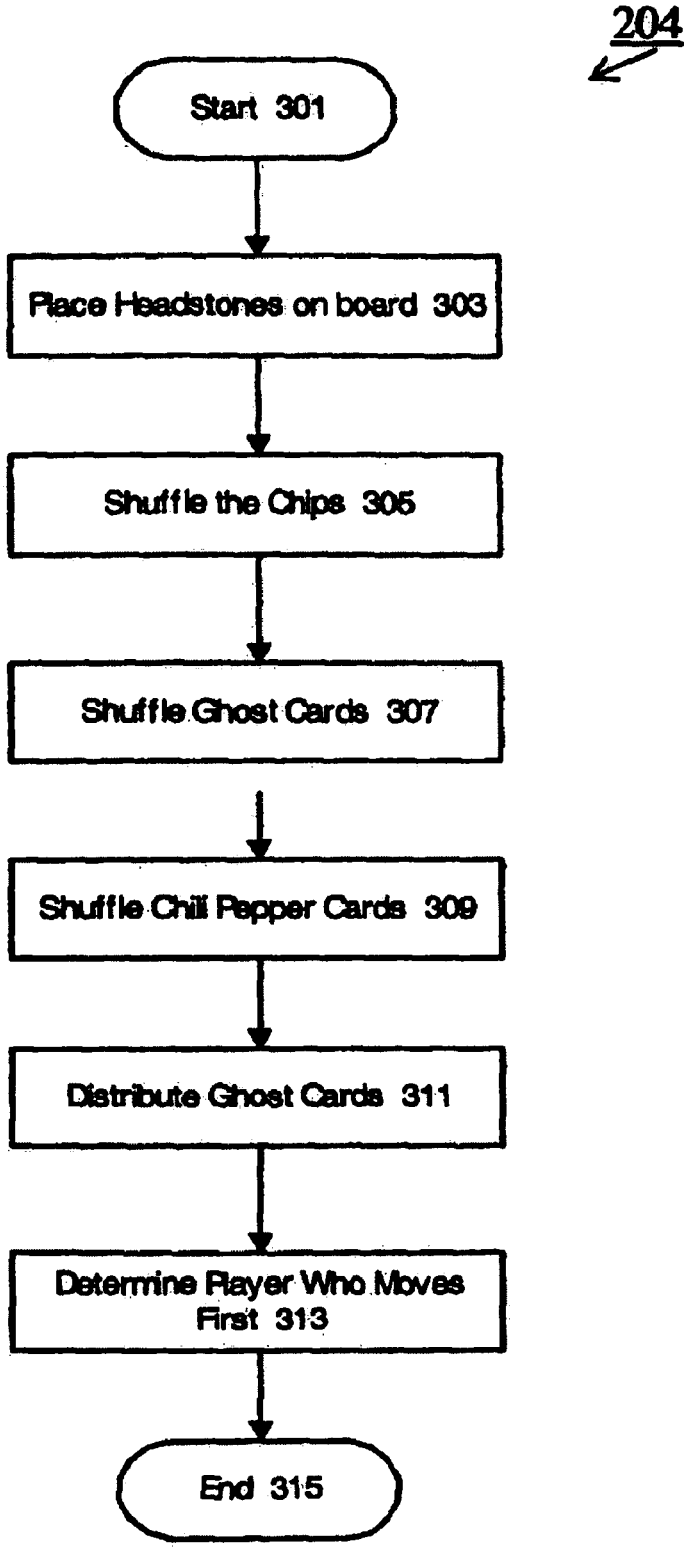
FIG. 8 is a flow chart illustrating a game set up method according to at least one embodiment.

FIG. 8 is a flow chart further illustrating details of game setup at 204 of FIG. 7. Referring to FIG. 8, set up 204 may commence at 301. The method may then proceed to 303 at which the players distribute headstones (of which there are thirteen in at least one embodiment) randomly on any numbered spaces of the game board. In at least one embodiment, the number of headstones may equal the number of personages or ghosts. Headstones are preferably placed on the spaces in a manner such that the numbers on the spaces remain visible. Play may then proceed to 305 at which the chips are shuffled. Each chip should be face up showing its "Zb" number. Play may then proceed to 307 at which the ghost cards are shuffled. Play may then proceed to 309 at which the bonus cards (e.g., chili pepper cards) are shuffled. Play may then proceed to 311 at which one of the players may distribute (e.g., deal out) the ghost cards to each player. In at least one embodiment, five ghost cards may be dealt face down to each player. Preferably, the ghost cards (and the bonus cards) are shuffled prior to dealing. Extra ghost cards remaining after dealing should be put aside without being revealed to any player. As each ghost card indicates a particular ghost (in an embodiment), the ghost cards 104 held by a player determines which ghost that player has to capture. In play, the ghost cards 104 held by each player should be hidden from the view of other players.

Play may then proceed to 313, at which it may be determined which player/hunter will move first. At 313, each player may choose a hunter pawn and roll the die. Up to five hunters may play in a single game. In the rare case that all five hunters roll a "2," the players roll again. Each player may then place his hunter pawn on any space of the game board showing the numbered rolled. In at least one embodiment, the player with the highest rolled number goes first. In an embodiment, in case of a tie with the highest number, the youngest aged player goes first. In an embodiment, play (e.g., the hunt) proceeds clockwise. The set up 204 may then end, at 315.

While the invention has been described with reference to the certain illustrated embodiments, the words that have been used herein are words of description, rather than words of limitation. Changes may be made, within the purview of the associated claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the associated claims.

I claim:

1. A gaming apparatus comprising:

a game board having spaces marked with a plurality of indicia arranged and numbered according to a plurality of rows of a Pascal's Triangle;

a plurality of game pawns, each of the pawns being constructed so as to occupy one of the spaces;

a plurality of chips, each of the chips having a denomination corresponding to the numbers on the game board spaces;

a plurality of markers bearing indicia representative of the personages that players distribute randomly on the game board;

a plurality of decks of cards; and a random number generator.

2. The apparatus of claim 1, in which the decks of cards include:

a first deck containing a plurality of cards associated with a personage, wherein each personage has characteristics, such as an associated characteristic, a characteristic number and a fixed number of points; and a second deck containing a plurality of cards bearing indicia instructing players how to implement special protection or activities/movement variations designed to advance their play.

3. The apparatus of claim 1, wherein the personages are ghosts.

4. The apparatus of claim 1, wherein the game board further includes one or more portals.

5. The apparatus of claim 4, wherein the number of the portals is four.

6. The apparatus of claim 1, wherein the spaces marked with a plurality of indicia arranged and numbered according to the plurality of rows of the Pascal's Triangle includes at least four sets of at least two rows of the Pascal's Triangle.

7. The apparatus of claim 1, in which the spaces have a square shape.

8. A gaming method comprising:

providing a game board having spaces marked with a plurality of indicia arranged and numbered according to a plurality of rows of a Pascal's Triangle;

providing a plurality of game pawns, each of the pawns being constructed so as to occupy one of the spaces;

providing a plurality of chips, each of the chips having a denomination corresponding to the numbers on the game board spaces;

providing a plurality of markers bearing indicia representative of the personages that players distribute randomly on the game board;

providing a plurality of decks of cards; and providing a random number generator;

moving a game piece among spaces of a game board having spaces marked with a plurality of indicia arranged and numbered according to a plurality of rows of the Pascal's Triangle, wherein the movement is conducted in accordance with rules of movement;

accumulating or decreasing player points in an amount equal to the point value of the spaces on the game board visited by the game piece;

acquiring one of a plurality of personages when the player points equals a number of points assigned to the acquired personage;

permitting the taking of actions against other players in accordance with an attribute assigned to the acquired personage; and acquiring one of a plurality of bonus cards when the player accumulates a chip having a bonus card indicator.

9. The method of claim 8, wherein the personages are ghosts.

10. The method of claim 8, wherein the moving of the game piece in accordance with rules of movement includes:

moving the game piece diagonally the number of steps equal to the number on the space upon which the game piece is positioned at the start of the turn;

prohibiting the game piece from landing on a space having a number that is the same as the number of the space upon which the game piece is positioned at the start of the turn; and prohibiting the game piece from landing on an occupied space.

11. The method of claim 10, wherein the moving of the game piece in accordance with rules of movement further includes:

prohibiting the game piece from landing on any space with a headstone except to capture a ghost.

12. The method of claim 8, the method further comprising:

performing game set up.

13. The method of claim 8, the method further comprising:

delivering personages to the underworld.

* * * * *